US012504008B1

(12) United States Patent
Chou et al.

(10) Patent No.: US 12,504,008 B1
(45) Date of Patent: Dec. 23, 2025

(54) AIR COMPRESSOR

(71) Applicant: UNIK WORLD INDUSTRIAL CO., LTD., Tainan (TW)

(72) Inventors: Wen San Chou, Tainan (TW); Cheng Hsien Chou, Tainan (TW)

(73) Assignee: UNIK WORLD INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 18/939,376

(22) Filed: Nov. 6, 2024

(30) Foreign Application Priority Data

Aug. 13, 2024 (TW) ..... 113130312

(51) Int. Cl.

| | |
|---|---|
| ***F04B 35/04*** | (2006.01) |
| ***F04B 37/12*** | (2006.01) |
| ***F04B 39/00*** | (2006.01) |
| ***F04B 39/10*** | (2006.01) |
| ***F04B 51/00*** | (2006.01) |

(52) U.S. Cl.
CPC ..... *F04B 35/04* (2013.01); *F04B 37/12* (2013.01); *F04B 39/0005* (2013.01); *F04B 39/10* (2013.01); *F04B 51/00* (2013.01)

(58) Field of Classification Search
CPC ..... F04B 35/04; F04B 37/12; F04B 39/0005; F04B 39/10; F04B 51/00
See application file for complete search history.

(56) References Cited

U.S. PATENT DOCUMENTS

| | | | | |
|---|---|---|---|---|
| 9,611,845 | B2 | 4/2017 | Schiavone et al. | |
| 2014/0134025 | A1* | 5/2014 | Chou | F04B 39/125 417/540 |
| 2014/0234135 | A1* | 8/2014 | Chou | F04B 35/04 417/321 |
| 2014/0283677 | A1* | 9/2014 | Chou | F02K 1/80 92/137 |

FOREIGN PATENT DOCUMENTS

| | | |
|---|---|---|
| CN | 208106702 | 11/2018 |
| JP | H0561476 U | 8/1993 |
| JP | 3249057 U | 10/2024 |
| TW | I805071 | 6/2023 |
| TW | M664307 | 12/2024 |

OTHER PUBLICATIONS

"Office Action of Taiwan Counterpart Application", issued on Feb. 4, 2025, p. 1-p. 4.
"Office Action of Japan counterpart Application", issued on Aug. 29, 2025, p. 1-p. 3.

* cited by examiner

*Primary Examiner* — Hoang M Nguyen
(74) *Attorney, Agent, or Firm* — JCIPRNET

(57) ABSTRACT

An air compressor includes an air reservoir, a motor, and a piston mechanism. The air reservoir has an air inlet and an air outlet. The piston mechanism is disposed in the air reservoir and includes a cylinder and a piston. The cylinder has a front end and a rear end opposite to each other, the front end is adjacent to the air inlet, and the piston is movably disposed in the cylinder and protrudes out from the (Continued)

rear end to be coupled to the motor. The motor is adapted to drive the piston to reciprocate along the cylinder, so as to drive air to pass through the air inlet, the front end, the rear end, and the air outlet sequentially.

10 Claims, 10 Drawing Sheets

AIR COMPRESSOR

CROSS-REFERENCE TO RELATED APPLICATION

This application claims the priority benefit of Taiwan application serial no. 113130312, filed on Aug. 13, 2024. The entirety of the above-mentioned patent application is hereby incorporated by reference herein and made a part of this specification.

BACKGROUND

Technical Field

The disclosure relates to an air compressor, and in particular to a piston type air compressor.

Description of Related Art

The vehicle-mounted air compressor may be used with a tire sealant bottle to repair and inflate the tires of the vehicle, and may also be used to inflate the tires of the vehicle without the tire sealant bottle. The air compressor may be a piston type air compressor. In the general piston type air compressor, the piston advances in the cylinder to compress the air in the cylinder, thereby causing the high-pressure air to flow from the front end of the cylinder to the air reservoir and be output. When the piston retreats in the cylinder, the space in the cylinder gradually becomes larger and the air pressure inside the cylinder decreases, the air is compressed the next time the piston advances, and thus a continuous cycle is created.

The existing piston type air compressor has the following technical problems. The air reservoir and the piston mechanism including the piston and the cylinder each occupy the configuration space in the piston type air compressor, and it is difficult to reduce the volume of the piston type air compressor. In addition, excessive noise during the operation of the piston mechanism may easily affect user experience of the customer. In addition, in the limited configuration space of the piston type air compressor, it is difficult to provide sufficient heat dissipation area to dissipate heat from the piston mechanism, and it is difficult to protect the piston mechanism from impact damage with sufficient protective structures.

SUMMARY

The disclosure provides an air compressor that can reduce the volume of the air compressor, reduce the noise of the piston mechanism, provide a sufficient heat dissipation area for the piston mechanism, and well protect the piston mechanism.

The air compressor of the disclosure includes an air reservoir, a motor, and a piston mechanism. The air reservoir has an air inlet and an air outlet. The piston mechanism is disposed in the air reservoir and includes a cylinder and a piston. The cylinder has a front end and a rear end opposite to each other. The front end is adjacent to the air inlet, and the piston is movably disposed in the cylinder and protrudes out from the rear end to be coupled to the motor. The motor is adapted to drive the piston to reciprocate along the cylinder, so as to drive the air to pass through the air inlet, the front end, the rear end, and the air outlet sequentially.

In an embodiment of the disclosure, the piston includes a piston head and a piston rod connected to each other. The piston head divides the interior of the cylinder into a first space and a second space. The first space is located between the front end and the piston head, the second space is located between the piston head and the rear end, and the piston rod is coupled to the motor.

In an embodiment of the disclosure, when the motor drives the piston head to move toward the rear end so that the air pressure in the first space is less than the air pressure outside the air reservoir, the air outside the air reservoir flows to the first space through the air inlet.

In an embodiment of the disclosure, the air compressor further includes a check valve, in which the check valve is disposed in the air inlet, and the check valve allows the air outside the air reservoir to flow to the first space through the air inlet and prevents the air in the first space from flowing out of the air reservoir through the air inlet.

In an embodiment of the disclosure, the piston head has an opening. When the motor drives the piston head to move toward the front end and the air pressure in the first space is greater than the air pressure in the second space, the air in the first space flows to the second space through the opening.

In an embodiment of the disclosure, the air compressor further includes a check valve, in which the check valve is disposed in the opening, and the check valve allows the air in the first space to flow to the second space through the opening and prevents the air in the second space from flowing to the first space through the opening.

In an embodiment of the disclosure, the air compressor further includes a pressure gauge, in which the pressure gauge is connected to the air reservoir.

In an embodiment of the disclosure, the air compressor further includes an air outlet tube, in which the air outlet tube is located outside the air reservoir and connected to the air outlet.

In an embodiment of the disclosure, the air compressor further includes a housing, in which the housing accommodates the air reservoir, the piston mechanism, and the motor, and the air outlet tube extends outside the housing.

In an embodiment of the disclosure, the air reservoir includes a first housing portion and a second housing portion, and the second housing portion is joined to the first housing portion so that the piston mechanism is hidden between the first housing portion and the second housing portion.

Based on the above, in the air compressor of the disclosure, the piston mechanism is disposed in the air reservoir. Accordingly, the piston mechanism does not occupy the configuration space outside the air reservoir and can reduce the volume of the air compressor. In addition, the noise generated during the operation of the piston mechanism is contained in the air reservoir, which can reduce the noise of the piston mechanism. In addition, the heat generated during the operation of the piston mechanism is dissipated in the air reservoir and can be released through the sufficiently large outer surface of the air reservoir. Furthermore, the piston mechanism is located in the air reservoir and is well protected from impact damage.

DESCRIPTION OF THE EMBODIMENTS

Figure 1:
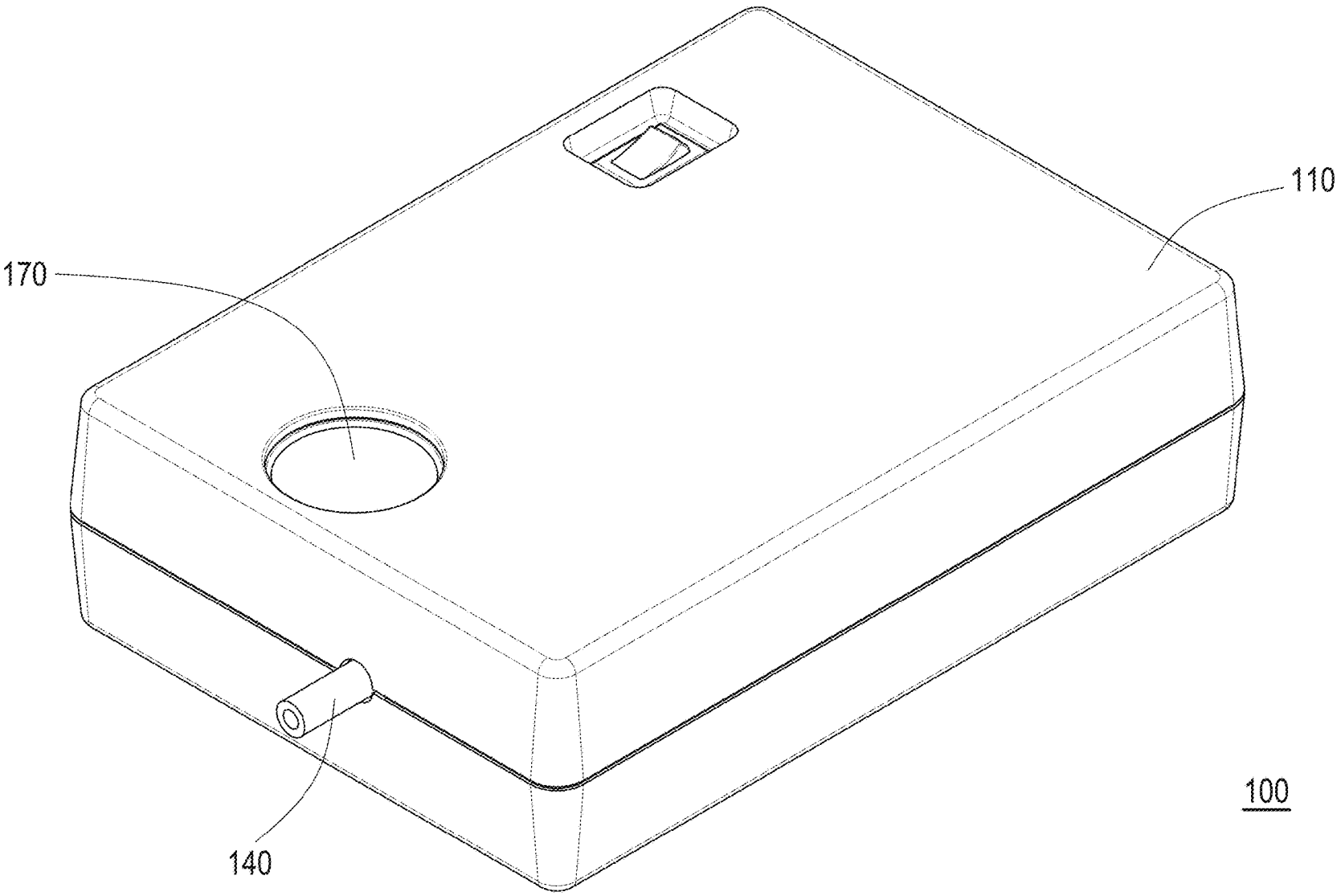
FIG. 1 is a perspective view of an air compressor according to an embodiment of the disclosure.
Figure 2:
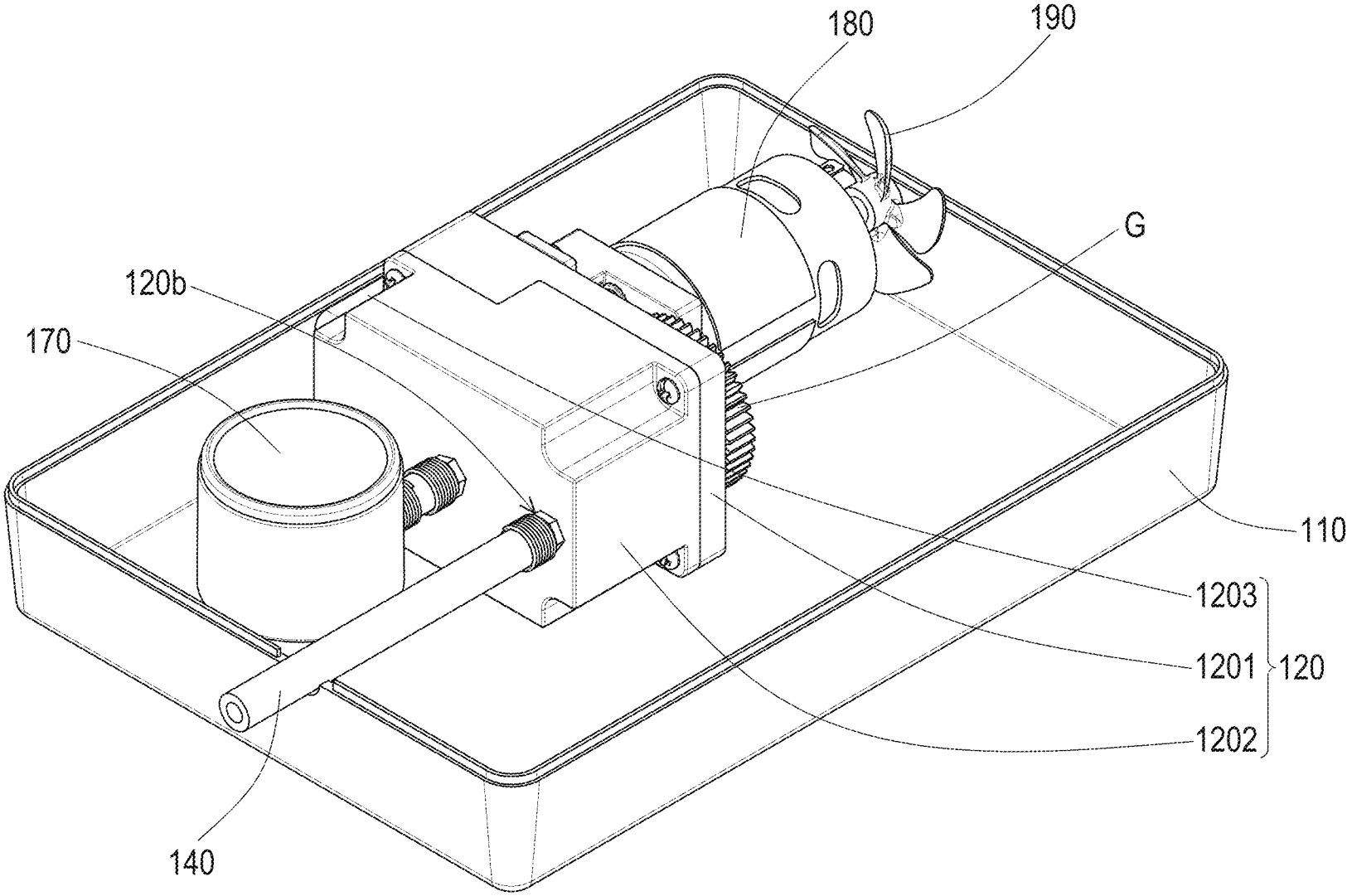
FIG. 2 is a perspective view of some components of the air compressor in FIG. 1.
Figure 3:
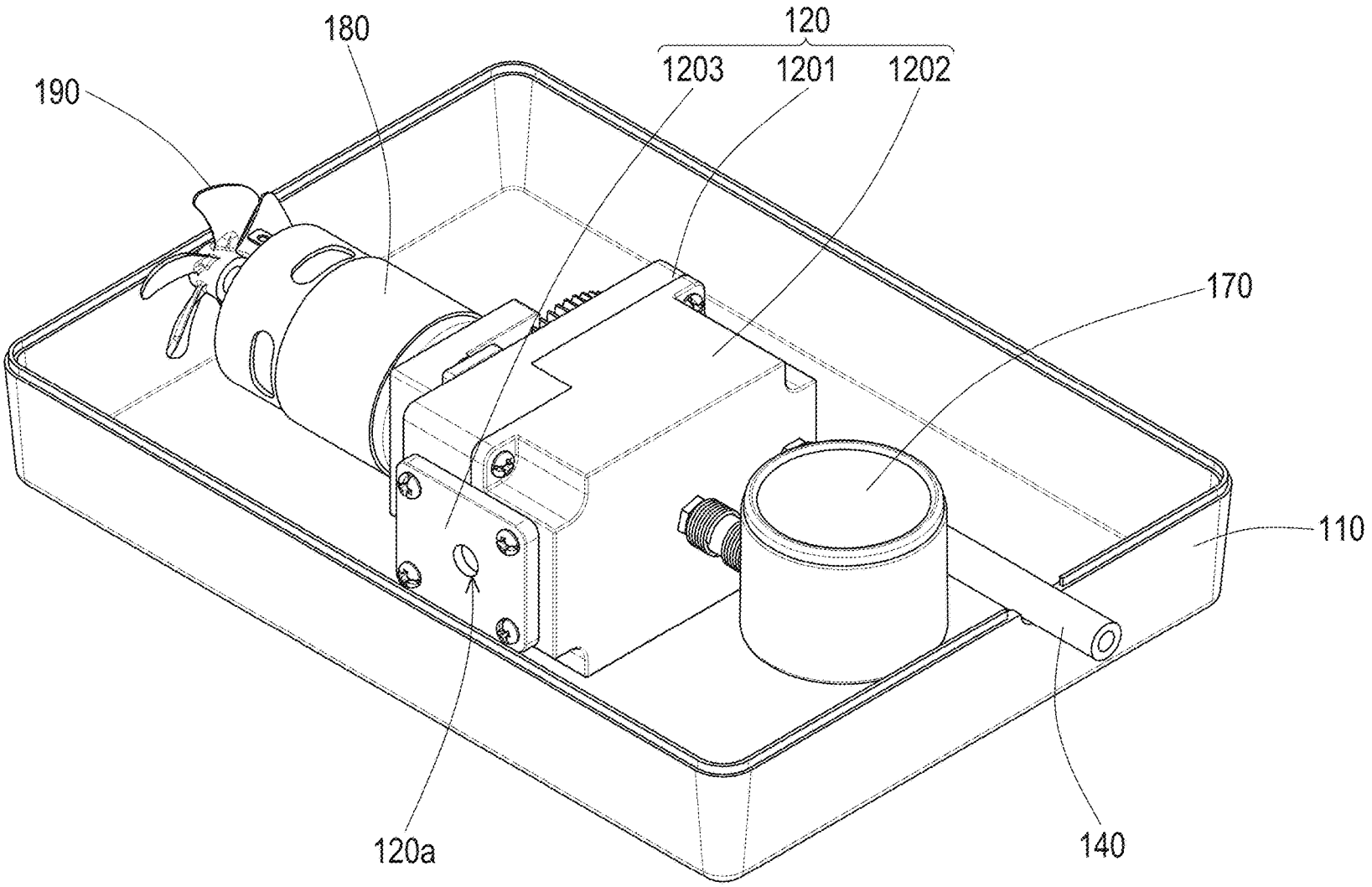
FIG. 3 is a perspective view of the air compressor in FIG. 2 from another perspective.
Figure 4:
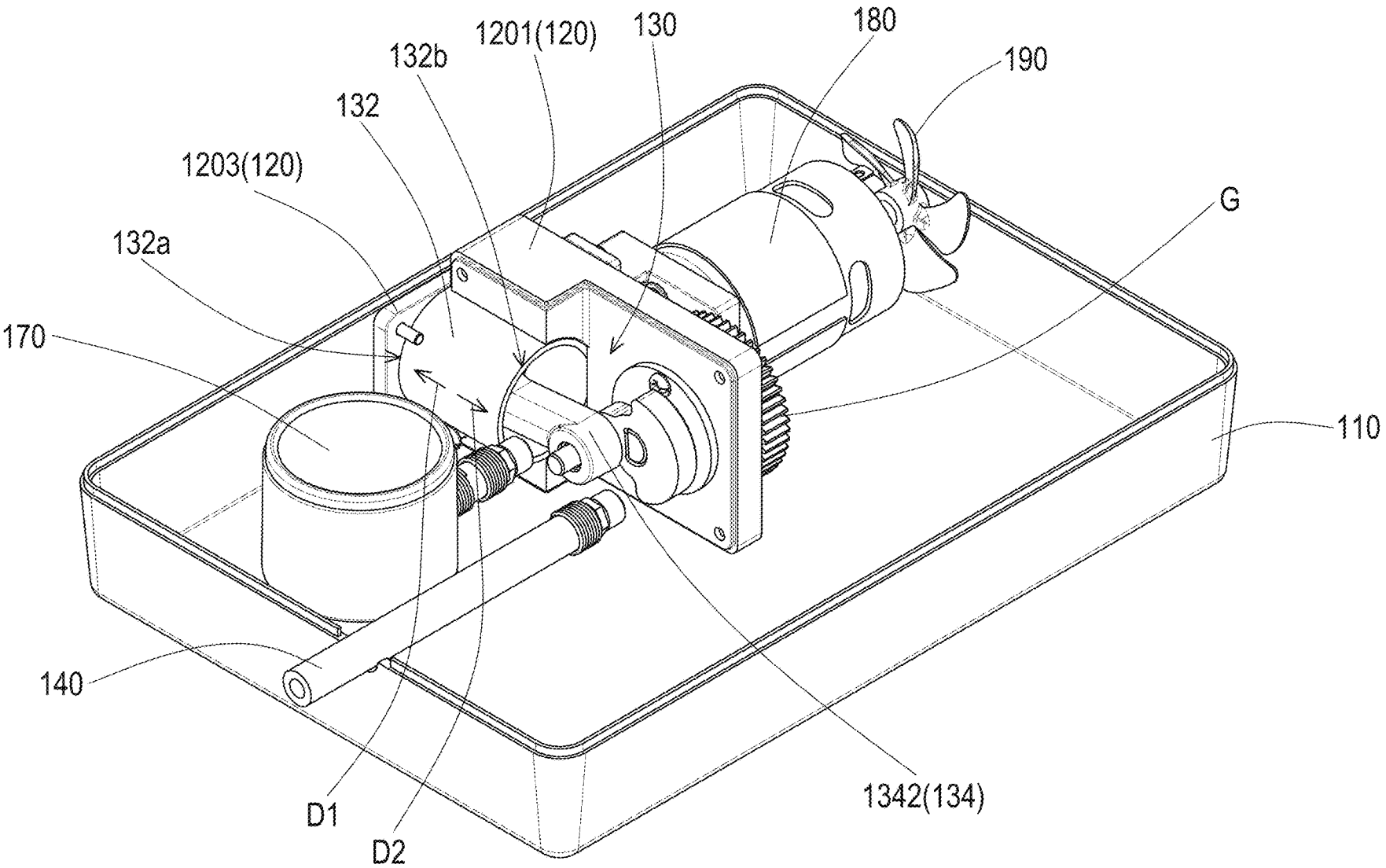
FIG. 4 is a perspective view of some components of the air compressor in FIG. 2.

FIG. 1 is a perspective view of an air compressor according to an embodiment of the disclosure. FIG. 2 is a perspective view of some components of the air compressor in FIG. 1. FIG. 3 is a perspective view of the air compressor in FIG. 2 from another perspective. FIG. 4 is a perspective view of some components of the air compressor in FIG. 2. Please refer to FIG. 1 to FIG. 4. An air compressor 100 of this embodiment is, for example, a vehicle-mounted air compressor, which is used to provide high-pressure air required for inflating and/or repairing tires of the vehicle. However, the disclosure is not limited thereto. The air compressor 100 includes a housing 110, an air reservoir 120, a piston mechanism 130, an air outlet tube 140, and a motor 180. The housing 110 accommodates the air reservoir 120, the piston mechanism 130, and the motor 180. The piston mechanism 130 is disposed in the air reservoir 120 and includes a cylinder 132 and a piston 134. As shown in FIG. 2 and FIG. 3, the air reservoir 120 has an air inlet 120*a* and an air outlet 120*b*. The air outlet tube 140 is located outside the air reservoir 120 and connected to the air outlet 120*b*. The air outlet tube 140 extends outside the housing 110.

As shown in FIG. 4, the cylinder 132 has a front end 132*a* and a rear end 132*b* opposite to each other. The front end 132*a* is adjacent to the air inlet 120*a* of the air reservoir 120, and the piston 134 is movably disposed in the cylinder 132 and protrudes out from the rear end 132*b* of the cylinder 132 to be coupled to the motor 180. The motor 180 is adapted to drive the piston 134 to reciprocate along the cylinder 132 in directions D1 and D2, so as to drive the air to pass through the air inlet 120*a* of the air reservoir 120, the front end 132*a* of the cylinder 132, the rear end 132*b* of the cylinder 132, and the air outlet 120*b* of the air reservoir 120 sequentially, and output via the air outlet tube 140.

As described above, in the air compressor 100 of this embodiment, the piston mechanism 130 is disposed in the air reservoir 120. Accordingly, the piston mechanism 130 does not occupy the configuration space outside the air reservoir 120 and can reduce the volume of the air compressor 100. In addition, the noise generated during the operation of the piston mechanism 130 is contained in the air reservoir 120, which can reduce the noise of the piston mechanism 130. In addition, the heat generated during the operation of the piston mechanism 130 is dissipated in the air reservoir 120 and can be released through the sufficiently large outer surface of the air reservoir 120. Furthermore, the piston mechanism 130 is located in the air reservoir 120 and is well protected from impact damage.

The following describes the operation manner of the air compressor 100 of this embodiment.

Figure 5:
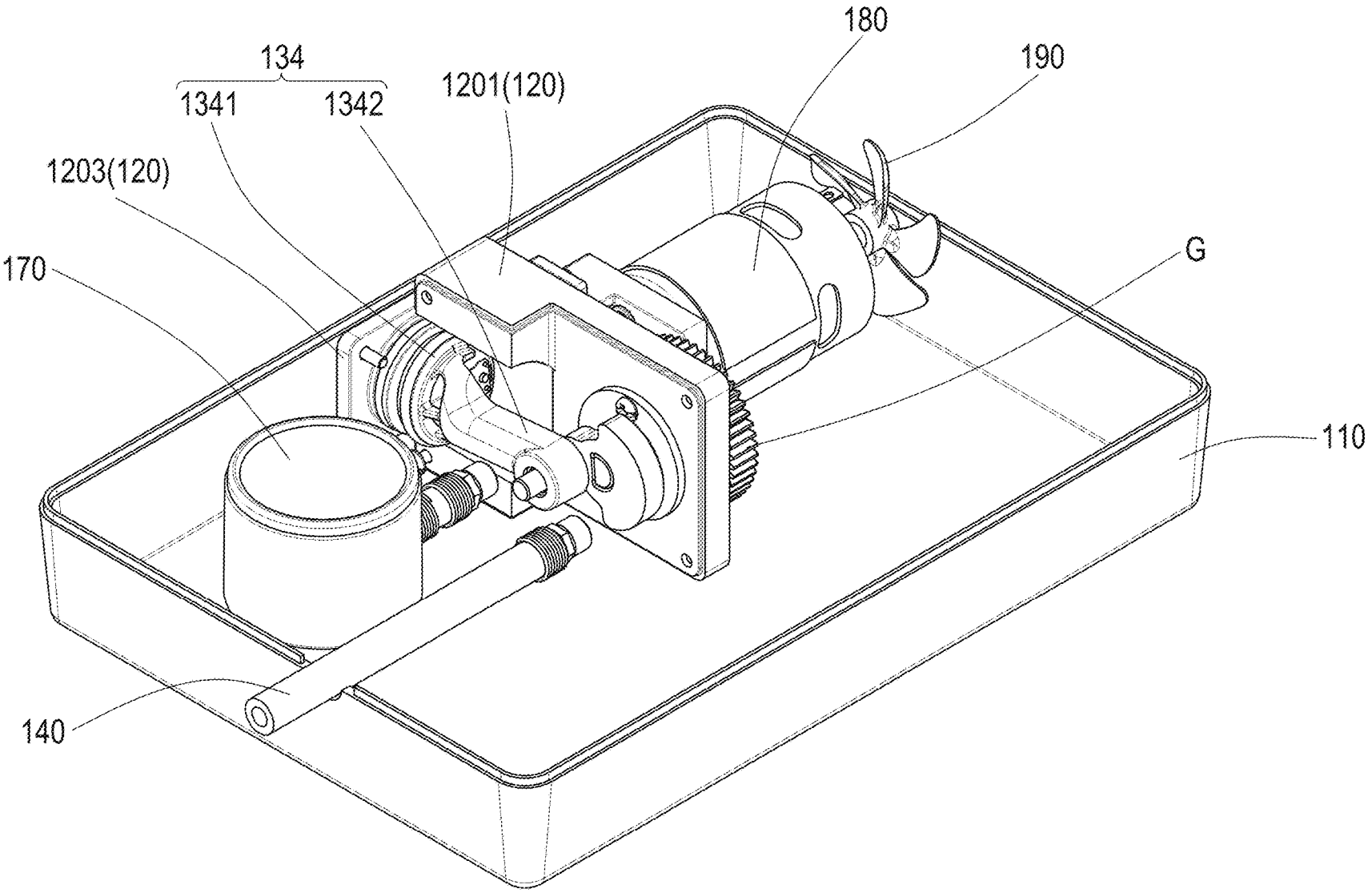
FIG. 5 is a perspective view of some components of the air compressor in FIG. 4.
Figure 6:
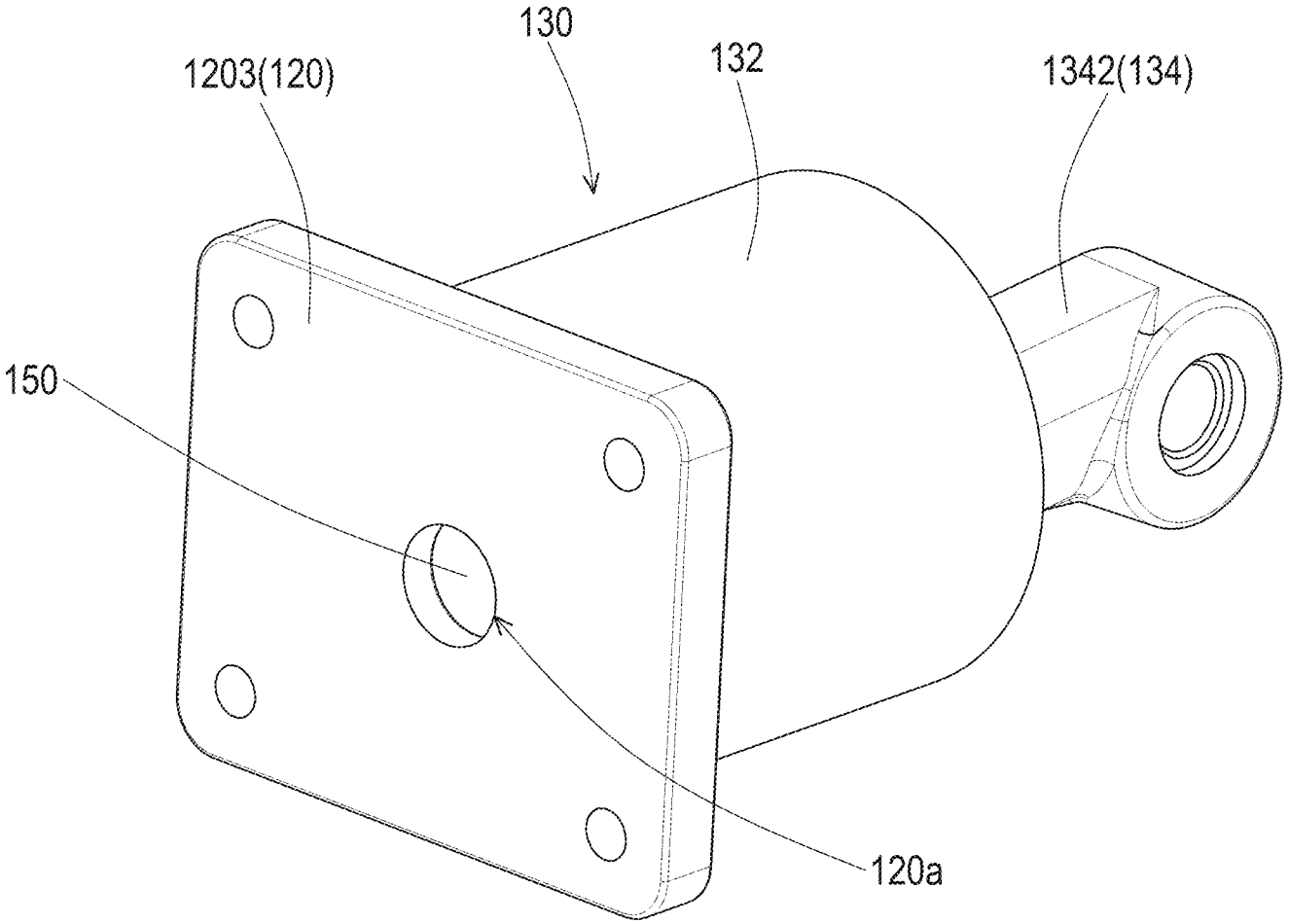
FIG. 6 is a perspective view of a partial structure of an air reservoir and some components of a piston mechanism in FIG. 5.
Figure 7:
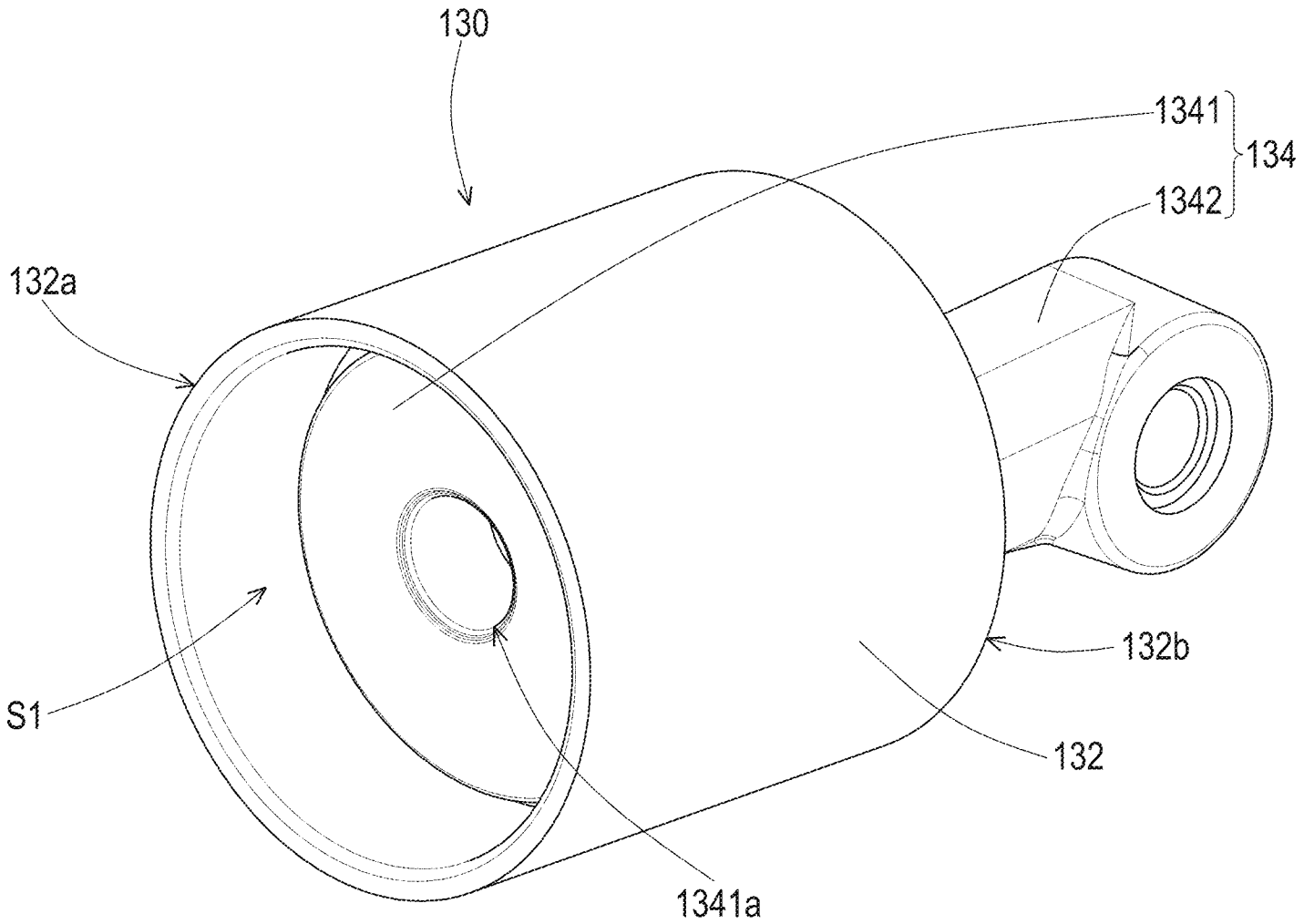
FIG. 7 is a perspective view of a cylinder and a piston in FIG. 6.
Figure 8:
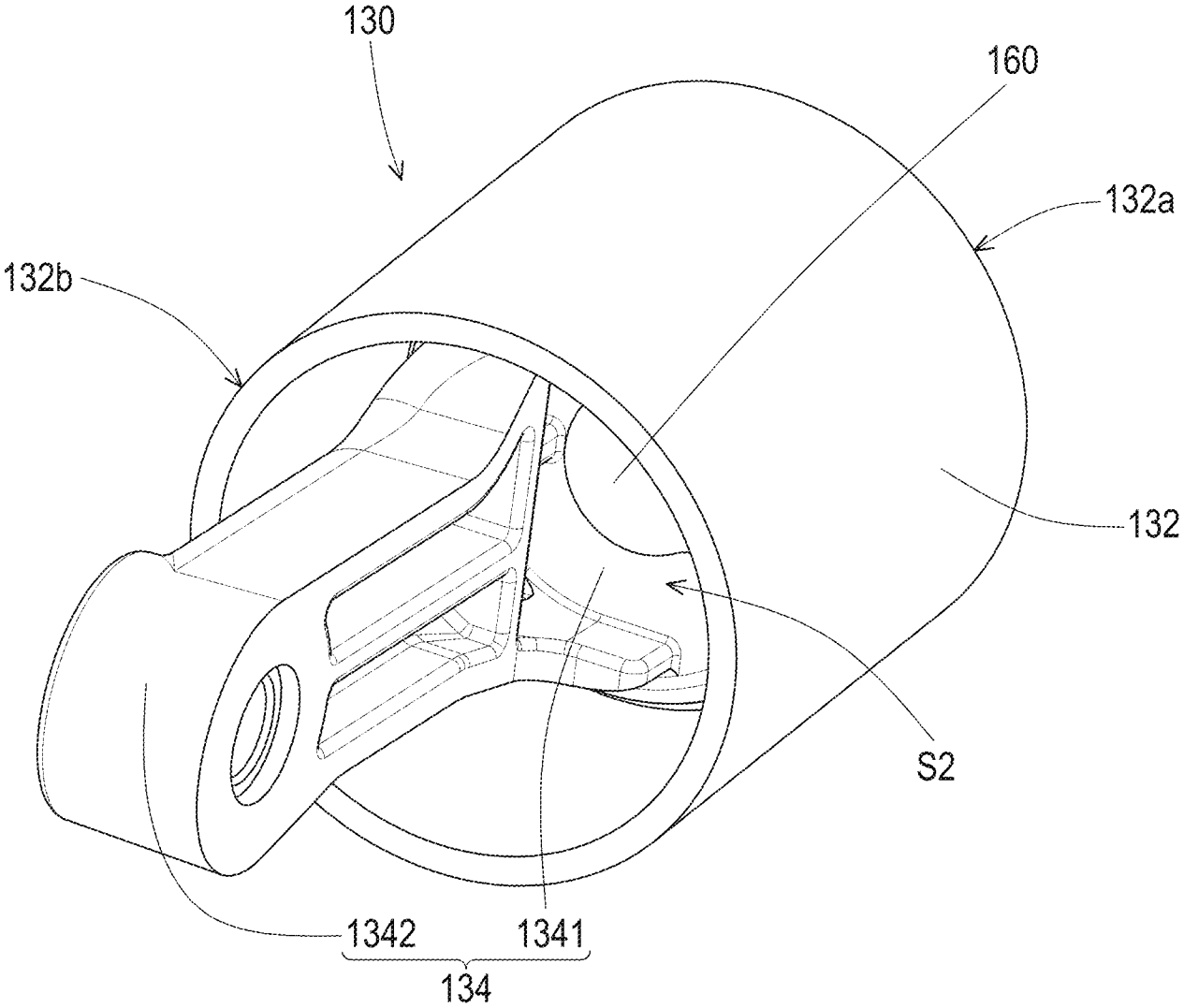
FIG. 8 is a perspective view of the cylinder and the piston in FIG. 7 from another perspective.

FIG. 5 is a perspective view of some components of the air compressor in FIG. 4. FIG. 6 is a perspective view of a partial structure of an air reservoir and some components of a piston mechanism in FIG. 5. FIG. 7 is a perspective view of a cylinder and a piston in FIG. 6. FIG. 8 is a perspective view of the cylinder and the piston in FIG. 7 from another perspective. Please refer to FIG. 5 to FIG. 8. The piston 134 of this embodiment includes a piston head 1341 and a piston rod 1342 connected to each other. The piston head 1341 divides the interior of the cylinder 132 into a first space S1 and a second space S2. The first space S1 is located between the front end 132*a* of the cylinder 132 and the piston head 1341, the second space S2 is located between the piston head 1341 and the rear end 132*b* of the cylinder 132, and the piston rod 1342 is coupled to the motor 180. In this embodiment, the piston rod 1342 is coupled to the motor 180 through a structure such as a gear set G (marked in FIG. 2, FIG. 4, and FIG. 5), and may be oscillated by the driving of the motor 180, thereby the piston head 1341 is driven to reciprocate along the cylinder 132. The method and principle of the reciprocating movement of the piston 134 are known in the technical field, so details will not be repeated here.

When the motor 180 drives the piston head 1341 to move toward the rear end 132*b* of the cylinder 132 so that the first space S1 is expanded and thus the air pressure in the first space S1 is less than the air pressure outside the air reservoir 120, the air outside the air reservoir 120 flows to the first space S1 through the air inlet 120*a* of the air reservoir 120 due to the pressure difference between the first space S1 and the outside of the air reservoir 120. In addition, the piston head 1341 has an opening 1341*a*. When the motor 180 drives the piston head 1341 to move toward the front end 132*a* of the cylinder 132 so that the first space S2 is reduced and thus the air pressure in the first space S1 is greater than the air pressure in the second space S2, the air in the first space S1 flows to the second space S2 through the opening 1341*a* due to the pressure difference between the first space S1 and the second space S2. By continuously circulating in this manner, the high-pressure air can be continuously output to the air outlet 120*b* of the air reservoir 120 through the second space S2 through the operation of the piston mechanism 130.

Figure 9:
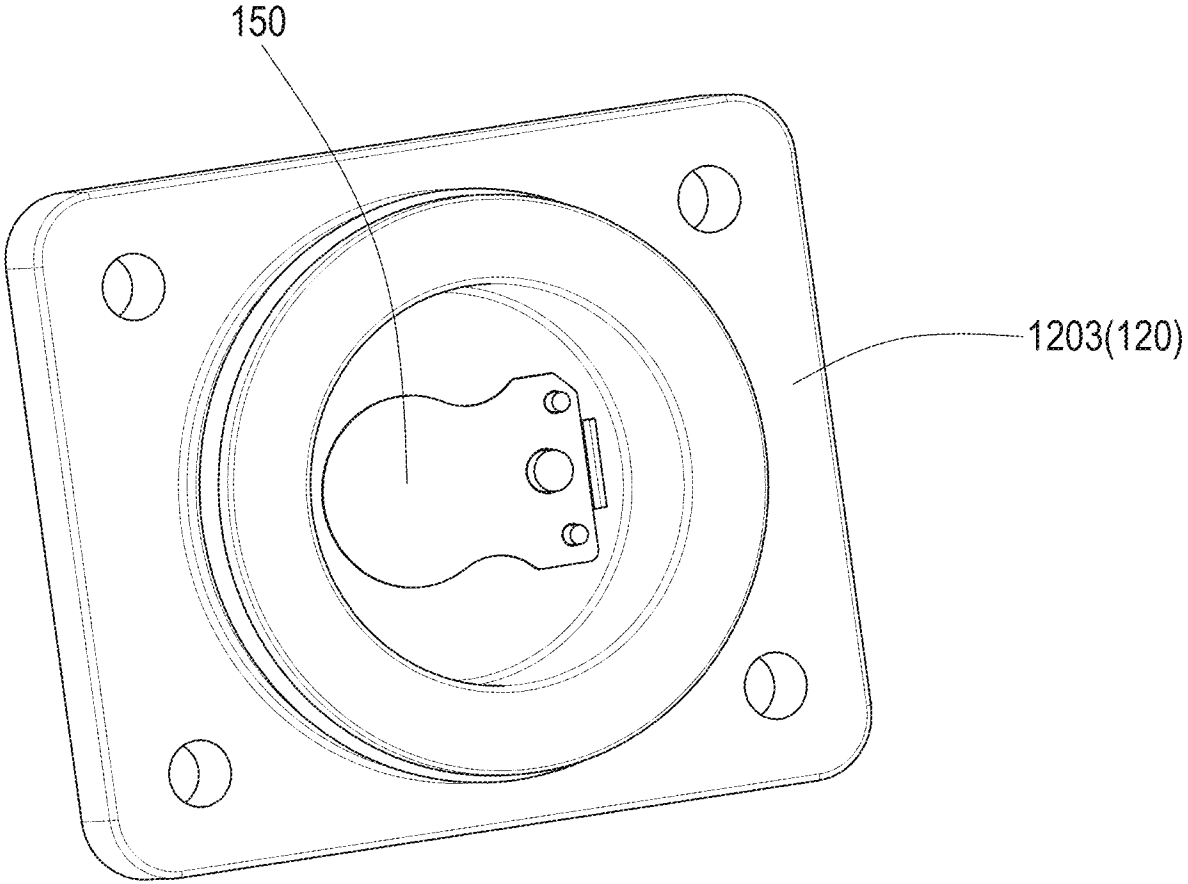
FIG. 9 is a perspective view of the partial structure of the air reservoir in FIG. 6 from another perspective.
Figure 10:
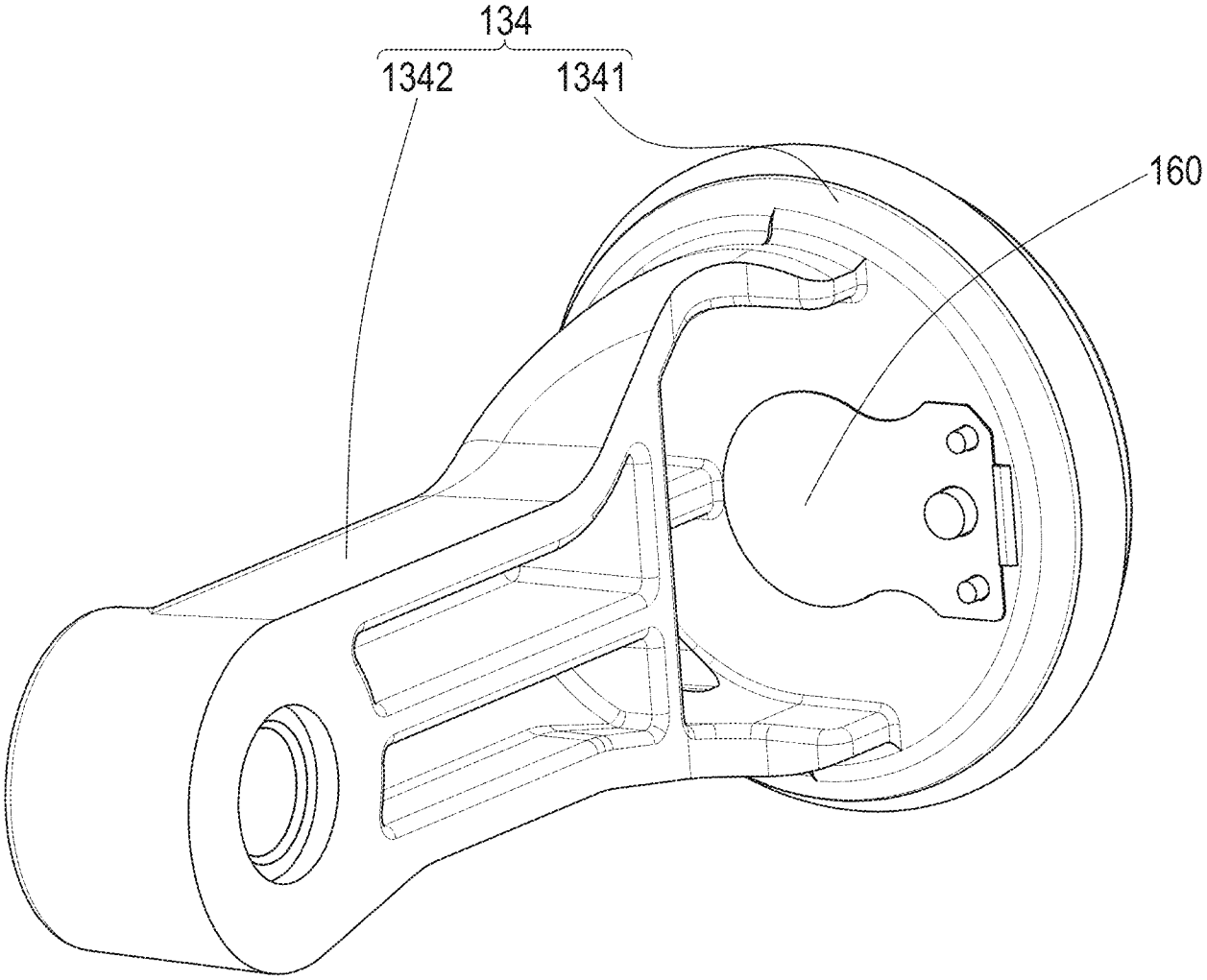
FIG. 10 is a perspective view of the piston in FIG. 8.

FIG. 9 is a perspective view of the partial structure of the air reservoir in FIG. 6 from another perspective. FIG. 10 is a perspective view of the piston in FIG. 8. Please refer to FIG. 9 and FIG. 10. Furthermore, the air compressor 100 of this embodiment further includes two check valves 150, 160. The check valve 150 is disposed in the air inlet 120*a* of the air reservoir 120 (shown in FIG. 6), and the check valve 160 is disposed in the opening 1341*a* of the piston head 1341 (shown in FIG. 7). The check valve 150 allows the air outside the air reservoir 120 to flow to the first space S1 through the air inlet 120*a* of the air reservoir 120 and prevents the air in the first space S1 from flowing out of the air reservoir 120 through the air inlet 120*a* of the air reservoir 120. The check valve 160 allows the air in the first space S1 to flow to the second space S2 through the opening 1341*a* of the piston head 1341 and prevents the air in the second space S2 from flowing to the first space S1 through the opening 1341*a* of the piston head 1341. The detailed configuration and function of the check valve are known in the technical field, so details will not be repeated here.

Please refer to FIG. 1 and FIG. 2. In this embodiment, the air compressor 100 further includes a pressure gauge 170. The pressure gauge 170 is connected to the air reservoir 120 and used to measure and display the air pressure in the air reservoir 120. The user may view the pressure value displayed by the pressure gauge 170 to know the pressure change of the air reservoir 120 during the operation of the piston mechanism 130. In addition, the air compressor 100 of this embodiment may further include a heat-dissipation fan 190 (marked in FIG. 1 to FIG. 5). The heat-dissipation fan 190 is connected to the motor 180 and driven by the motor 180 to generate a heat-dissipation airflow to the piston mechanism 130 and the air reservoir 120 for heat dissipation.

Please refer to FIG. 2 and FIG. 4. The air reservoir 120 of this embodiment includes a first housing portion 1201, a second housing portion 1202, and an end portion 1203. The second housing portion 1202 is joined to the first housing portion 1201 so that the piston mechanism 130 is hidden between the first housing portion 1201 and the second housing portion 1202. The end portion 1203 is joined to the first housing portion 1201 and the second housing portion 1202, and the air inlet 120*a* is formed in the end portion 1203. In other embodiments, the air reservoir 120 may be formed by other appropriate ways, and the disclosure is not limited thereto. In addition, the air outlet tube 140 may be connected to any appropriate position on the outer surface of the air reservoir 120 according to configuration and design requirements, and the disclosure is not limited thereto.

In the embodiment, sealing elements may be disposed between the first housing portion 1201, the second housing portion 1202, the end portion 1203, and the cylinder 132, and between the first housing portion 1201 and the transmission shaft of the gear set G to prevent leakage of the air in the air reservoir 120. The specific type and disposition manner of the sealing element are well known in the technical field, so details will not be repeated here.

In summary, in the air compressor of the disclosure, the piston mechanism is disposed in the air reservoir. Accordingly, the piston mechanism does not occupy the configuration space outside the air reservoir and can reduce the volume of the air compressor. In addition, the noise generated during the operation of the piston mechanism is contained in the air reservoir, which can reduce the noise of the piston mechanism. In addition, the heat generated during the operation of the piston mechanism is dissipated in the air reservoir and can be released through the sufficiently large outer surface of the air reservoir. Furthermore, the piston mechanism is located in the air reservoir and is well protected from impact damage. Moreover, the air outlet tube may be connected to any position on the outer surface of the air reservoir, which allows greater freedom in configuration.

What is claimed is:

1. An air compressor, comprising:

an air reservoir having an air inlet and an air outlet;

a motor; and a piston mechanism disposed in the air reservoir and comprising a cylinder and a piston, wherein the cylinder has a front end and a rear end opposite to each other, the front end is adjacent to the air inlet, and the piston is movably disposed in the cylinder and protrudes out from the rear end to be coupled to the motor, wherein the motor is adapted to drive the piston to reciprocate along the cylinder, so as to drive air to pass through the air inlet, the front end, the rear end, and the air outlet sequentially.

2. The air compressor as claimed in claim 1, wherein the piston comprises a piston head and a piston rod connected to each other, the piston head divides an interior of the cylinder into a first space and a second space, the first space is located between the front end and the piston head, the second space is located between the piston head and the rear end, and the piston rod is coupled to the motor.

3. The air compressor as claimed in claim 2, wherein in response to the motor driving the piston head to move toward the rear end so that an air pressure in the first space is less than an air pressure outside the air reservoir, air outside the air reservoir flows to the first space through the air inlet.

4. The air compressor as claimed in claim 2, further comprising a check valve, wherein the check valve is disposed in the air inlet, and the check valve allows air outside the air reservoir to flow to the first space through the air inlet and prevents air in the first space from flowing out of the air reservoir through the air inlet.

5. The air compressor as claimed in claim 2, wherein the piston head has an opening, in response to the motor driving the piston head to move toward the front end so that an air pressure in the first space is greater than an air pressure in the second space, air in the first space flows to the second space through the opening.

6. The air compressor as claimed in claim 5, further comprising a check valve, wherein the check valve is disposed in the opening, and the check valve allows the air in the first space to flow to the second space through the opening and prevents air in the second space from flowing to the first space through the opening.

7. The air compressor as claimed in claim 1, further comprising a pressure gauge, wherein the pressure gauge is connected to the air reservoir.

8. The air compressor as claimed in claim 1, further comprising an air outlet tube, wherein the air outlet tube is located outside the air reservoir and connected to the air outlet.

9. The air compressor as claimed in claim 8, further comprising a housing, wherein the housing accommodates the air reservoir, the piston mechanism, and the motor, and the air outlet tube extends outside the housing.

10. The air compressor as claimed in claim 1, wherein the air reservoir comprises a first housing portion and a second housing portion, the second housing portion is joined to the first housing portion so that the piston mechanism is hidden between the first housing portion and the second housing portion.

* * * * *